US009194266B2

(12) United States Patent
Silver et al.

(10) Patent No.: US 9,194,266 B2
(45) Date of Patent: Nov. 24, 2015

(54) EXHAUST SYSTEM

(75) Inventors: Ronald Graham Silver, Peoria, IL (US); Paul Sai Keat Wang, Peoria Heights, IL (US); David T. Montgomery, Edelstein, IL (US)

(73) Assignee: Caterpillar Inc., Peoria, IL (US)

( * ) Notice: Subject to any disclaimer, the term of this patent is extended or adjusted under 35 U.S.C. 154(b) by 222 days.

(21) Appl. No.: 13/560,110

(22) Filed: Jul. 27, 2012

(65) Prior Publication Data

US 2014/0026541 A1 Jan. 30, 2014

(51) Int. Cl.

| | |
|---|---|
| ***F01N 3/00*** | (2006.01) |
| ***F01N 3/02*** | (2006.01) |
| ***F01N 3/10*** | (2006.01) |
| ***F01N 3/20*** | (2006.01) |
| ***F02M 43/00*** | (2006.01) |

(52) U.S. Cl.
CPC . *F01N 3/10* (2013.01); *F02M 43/00* (2013.01)

(58) Field of Classification Search
USPC ..... 60/286, 295, 299, 300, 301
See application file for complete search history.

(56) References Cited

U.S. PATENT DOCUMENTS

| | | | | |
|---|---|---|---|---|
| 5,260,043 | A | 11/1993 | Li et al. | |
| 5,336,476 | A | 8/1994 | Kintaichi et al. | |
| 5,451,385 | A * | 9/1995 | Hansel et al. | 423/213.5 |
| 5,524,432 | A * | 6/1996 | Hansel | 60/274 |
| 5,891,409 | A | 4/1999 | Hsiao et al. | |
| 5,893,267 | A | 4/1999 | Vogtlin et al. | |
| 6,682,709 | B2 | 1/2004 | Sudduth et al. | |
| 6,709,643 | B1 | 3/2004 | Ozkan et al. | |
| 7,488,462 | B2 | 2/2009 | Ozkan et al. | |
| 7,987,663 | B2 | 8/2011 | Hancu et al. | |
| 8,057,745 | B2 | 11/2011 | Toyoda et al. | |
| 2005/0002839 | A1 | 1/2005 | Ohtsuka et al. | |
| 2010/0000202 | A1 | 1/2010 | Fisher et al. | |
| 2010/0023241 | A1 | 1/2010 | Guo et al. | |
| 2010/0175370 | A1 * | 7/2010 | Bunge | 60/277 |

* cited by examiner

*Primary Examiner* — Audrey K Bradley
*Assistant Examiner* — Dapinder Singh
(74) *Attorney, Agent, or Firm* — Finnegan, Henderson, Farabow, Garrett & Dunner, LLP

(57) ABSTRACT

A power system includes a dual fuel engine, a first fuel source configured to provide a first fuel to the engine, and a second fuel source configured to provide a second fuel to the engine different than the first fuel. The power system also includes an exhaust system configured to receive combustion exhaust from the engine. The exhaust system includes a reduction catalyst comprising palladium catalyst material and an oxidation catalyst comprising cobalt catalyst material. Additionally, changing a ratio of the first fuel provided to the engine relative to the second fuel changes a NOx conversion efficiency of the reduction catalyst.

20 Claims, 2 Drawing Sheets

EXHAUST SYSTEM

TECHNICAL FIELD

The present disclosure is directed to an exhaust system and, more particularly, to an exhaust system that implements selective catalytic reduction (SCR).

BACKGROUND

Internal combustion engines, including diesel engines, gasoline engines, gaseous fuel-powered engines, and other engines known in the art exhaust a complex mixture of air pollutants. These air pollutants are composed of gaseous compounds such as nitrogen oxides ($NO_X$), and solid particulate matter also known as soot. Due to increased awareness of the environment, exhaust emission standards have become more stringent, and the amount of $NO_X$ and soot emitted to the atmosphere by an engine may be regulated depending on the type of engine, size of engine, and/or class of engine.

In order to ensure compliance with the regulation of $NO_X$, some engine manufacturers have implemented an exhaust treatment strategy incorporating SCR. SCR is a process where a gaseous or liquid reductant, most commonly urea or ammonia, is injected into the exhaust gas stream of an engine and is absorbed onto a substrate that has been coated with a reduction catalyst. As the exhaust passes through the substrate, the reductant reacts with $NO_X$ in the exhaust gas to form $H_2O$ and $N_2$. In general, SCR is most effective when a concentration of NO to $NO_2$ supplied to the reduction catalyst is about 1:1. In order to achieve this optimum ratio, a diesel oxidation catalyst (DOC) is often located upstream of the substrate to convert NO to $NO_2$.

Although SCR with urea or ammonia is useful in some exhaust treatment systems, the use of such reductants can be hazardous. For example, ammonia can cause the direct oxidation of machine components, and the formation of ammonium salts can further corrode such components. Moreover, excess ammonia injected into the exhaust flow upstream of the substrate can often "slip" past the substrate, thus requiring the use of an additional "clean-up catalyst" downstream of the substrate to capture ammonia slip before it is released to the environment. Such clean-up catalysts increase the size, cost, and complexity of the exhaust treatment system.

As an alternative to SCR with urea or ammonia, an SCR process in which hydrocarbons are used as reducing agents may be employed. For example, combustion exhaust produced by natural gas engines and other like combustion engines is principally composed of methane and other hydrocarbons. Such hydrocarbons are capable of acting as reductants in the SCR process under certain conditions, and using such hydrocarbons as reducing agents in the SCR process eliminates the need for carrying a supply of hazardous reductants on the machine.

An exemplary system utilizing the SCR process to treat combustion exhaust is disclosed in U.S. Pat. No. 7,488,462 (the '462 patent). For example, the '462 patent teaches a lean-burn natural gas engine fluidly connected to a catalyst system. The catalyst system includes an oxidation catalyst configured to oxidize NO to $NO_2$. The catalyst system also includes a reduction catalyst configured to reduce $NO_2$ to $N_2$ in the presence of methane and other hydrocarbons present in the exhaust stream.

While the system taught in the '462 patent may be utilized to treat exhaust produced by a natural gas engine, it may be difficult to optimize the efficiency of the disclosed system. For instance, it is understood that increasing the ratio of non-methane hydrocarbons to methane in the exhaust may increase the effectiveness of known reduction catalysts. However, the system taught in the '462 patent does not allow engine operators to increase the proportion of non-methane hydrocarbons in the exhaust. While methane and other hydrocarbons used as reducing agents by the system of the '462 patent may be plentiful in the engine exhaust, these hydrocarbons are easily combusted at elevated exhaust temperatures in the presence of oxygen. As a result of such combustion, a desired amount of hydrocarbons may not be available to sufficiently react with NOx.

The system of the present disclosure solves one or more of the problems set forth above.

SUMMARY

In an exemplary embodiment of the present disclosure, a power system includes a dual fuel engine, a first fuel source configured to provide a first fuel to the engine, and a second fuel source configured to provide a second fuel to the engine different than the first fuel. The power system also includes an exhaust system configured to receive combustion exhaust from the engine. The exhaust system includes a reduction catalyst comprising palladium catalyst material and an oxidation catalyst comprising cobalt catalyst material. Additionally, changing a ratio of the first fuel provided to the engine relative to the second fuel changes a NOx conversion efficiency of the reduction catalyst.

In another exemplary embodiment of the present disclosure, a machine includes a dual fuel engine configured to provide power to a component of the machine and to produce a combustion exhaust. The machine also includes an exhaust system configured to receive the exhaust. The exhaust system includes a treatment device having a reduction catalyst, an oxidation catalyst, and a substrate. The reduction catalyst includes palladium catalyst material, the oxidation catalyst includes cobalt catalyst material, and the substrate includes an inorganic oxide. The machine also includes a sensor configured to determine a characteristic of the exhaust and to generate a signal indicative of the characteristic. The machine further includes a controller in communication with the engine, the exhaust system, and the sensor. The controller is configured to change a ratio of a first fuel provided to the engine relative to a second fuel provided to the engine different than the first fuel in response to the signal.

In a further exemplary embodiment of the present disclosure, a method of controlling a power system includes providing a first fuel to a dual fuel engine, providing a second fuel to the engine different than the first fuel, and combusting the first and second fuels with the engine to produce combustion exhaust containing NOx and having a desired total hydrocarbon level. The method also includes oxidizing a portion of the exhaust with an oxidation catalyst including cobalt catalyst material, and reducing the NOx with a reduction catalyst including palladium catalyst material. In such a method, the desired total hydrocarbon level is achieved by selectively changing a ratio of the first fuel provided to the engine relative to the second fuel provided to the engine.

DETAILED DESCRIPTION

Figure 1:
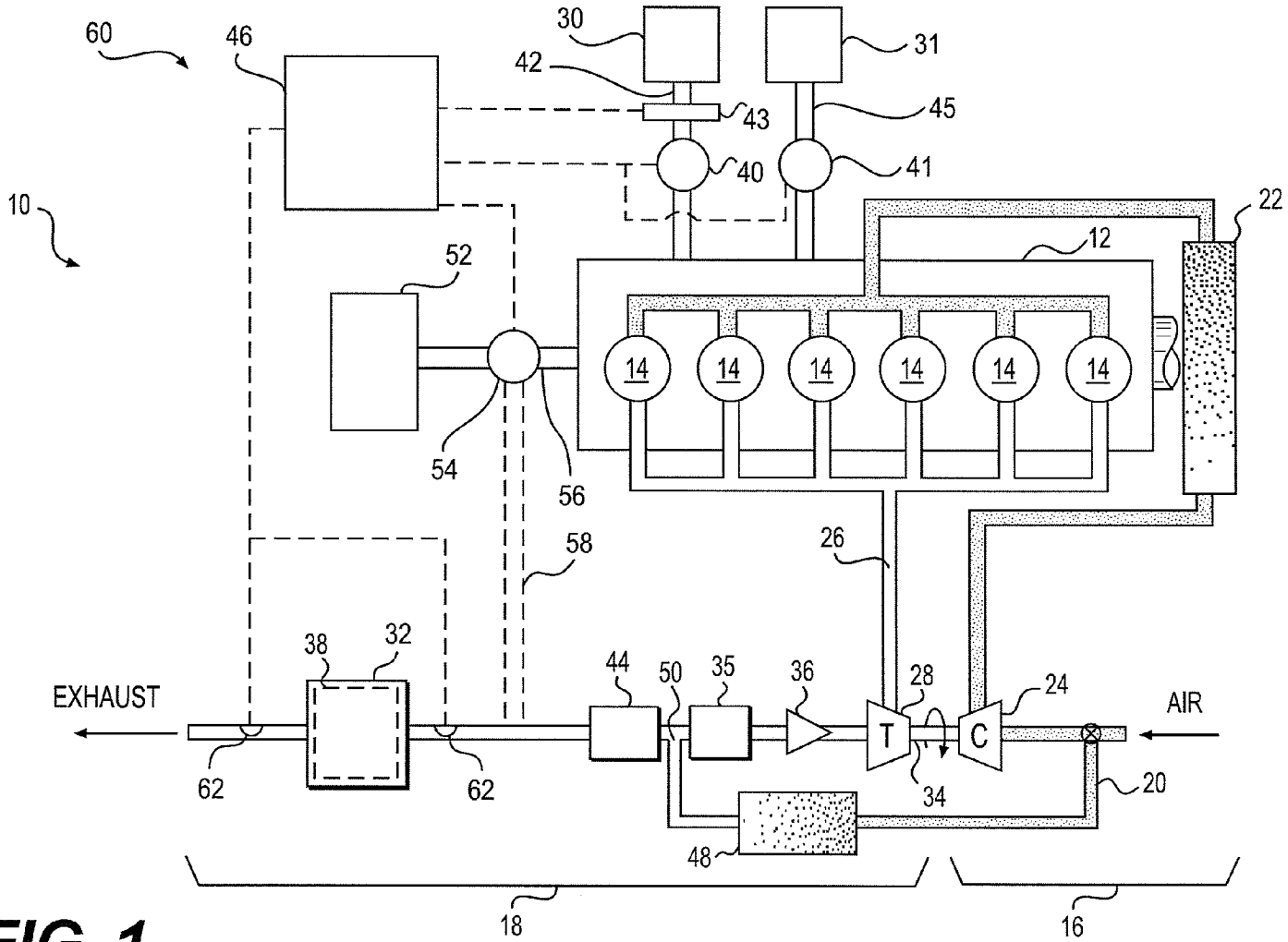
FIG. 1 is a schematic and diagrammatic illustration of an exemplary disclosed power system.

FIG. 1 illustrates an exemplary power system 10. For the purposes of this disclosure, power system 10 is depicted and described as a dual fuel internal combustion engine. Such dual fuel engines may comprise, for example, any internal combustion engine configured to combust two different fuels and/or air-fuel mixtures. Such engines may include, for example, a diesel fuel/natural gas engine or other like combustion engine. Such engines may also include an engine configured to combust diesel fuel, and a mixture of natural gas and air. It is also contemplated that power system 10 may embody any other type of combustion engine, such as, for example, a gasoline or a gaseous fuel-powered engine, a lean-burn natural gas engine, a diesel-fueled engine, and/or other like engines. Power system 10 may include an engine block 12 at least partially defining a plurality of cylinders 14, and a plurality of piston assemblies (not shown) disposed within cylinders 14 to form combustion chambers. It is contemplated that power system 10 may include any number of combustion chambers and that the combustion chambers may be disposed in an "in-line" configuration, a "V" configuration, or in any other conventional configuration.

Multiple separate sub-system may be included within power system 10. For example, power system 10 may include an air induction system 16, an exhaust system 18, and a recirculation loop 20. Air induction system 16 may be configured to direct air, or an air and fuel mixture, into power system 10 for subsequent combustion. Exhaust system 18 may exhaust byproducts of the combustion to the atmosphere. Recirculation loop 20 may be configured to direct a portion of the gases from exhaust system 18 back into air induction system 16 for subsequent combustion.

Air induction system 16 may include multiple components that cooperate to condition and introduce compressed air into cylinders 14. For example, air induction system 16 may include an air cooler 22 located downstream of one or more compressors 24. Compressors 24 may be connected to pressurize inlet air directed through cooler 22. It is contemplated that air induction system 16 may include different or additional components than described above such as, for example, a throttle valve, variable valve actuators associated with each cylinder 14, filtering components, compressor bypass components, and other known components, if desired. It is further contemplated that compressor 24 and/or cooler 22 may be omitted, if a naturally aspirated engine is desired.

In exemplary embodiments in which the power system 10 comprises a dual fuel engine, the power system 10 may include first and second fuel sources 30, 31 associated with the engine. For example, first and second fuel sources 30, 31 may be fluidly connected to the engine and configured to direct respective flows of combustible fuel to cylinders 14 for combustion. In exemplary embodiments, first and second fuel source 30, 31 may comprise separate fuel tanks, reservoirs, and/or other like structures configured to store combustible fuels in solid, liquid, or gaseous form. In exemplary embodiments, first and second fuel sources 30, 31 may be filled with different fuels. Fuel may be stored within one or both of first and second fuel sources 30, 31 at any desired positive pressure. In such embodiments, first and second fuel sources 30, 31 may include one or more valves, injectors, flow restrictors, and/or other like flow control devices (not shown) configured to assist in providing a pressurized flow of fuel to the engine.

Alternatively, at least one of first and second fuel sources 30, 31 may be fluidly connected to a pump 40, 41 configured to pressurize the fuel and direct a pressurized flow of fuel from the at least one fuel source 30, 31 to the engine for combustion. Fuel may be directed from first and second fuel sources 30, 31 to the engine via respective passages 42, 45, and such passages may include one or more valves, injectors, flow restrictors, and/or other like flow control devices (not shown) configured to assist in providing a pressurized flow of fuel to the engine. Together with pumps 40, 41, operation of such flow control devices may be controlled to regulate a ratio of the first fuel provided to the engine to the second fuel provided to the engine. In particular, such a ratio may be modified and/or otherwise controlled based on one or more parameters of power system 10 and/or characteristics of combustion exhaust produced by the engine.

In exemplary embodiments in which it is desirable to provide an air-fuel mixture to the engine for combustion, at least one of first and second fuel sources 30, 31 may be fluidly connected to a mixer 43. Mixer 43 may be configured to draw in ambient air and mix such inlet air with fuel from at least one of first and second fuel sources 30, 31. Mixer 43 may include, for example, one or more impellers or other like rotational components configured to create turbulent flow within a housing of mixer 43, and to thereby create a substantially homogeneous mixture of air and fuel exiting mixer 43.

Exhaust system 18 may include multiple components that condition and direct exhaust from cylinders 14 to the atmosphere. For example, exhaust system 18 may include an exhaust passageway 26, one or more turbines 28 driven by the exhaust flowing through passageway 26, a particulate collection device 35 located downstream of turbine 28, and a treatment device 32 fluidly connected downstream of particulate collection device 35. It is contemplated that exhaust system 18 may include different or additional components than described above such as, for example, bypass components, an exhaust compression or restriction brake, an attenuation device, additional exhaust treatment devices, and other known components, if desired.

Turbine 28 may be located to receive exhaust leaving power system 10, and may be connected to one or more compressors 24 of air induction system 16 by way of a common shaft 34 to form a turbocharger. As the hot exhaust gases exiting power system 10 move through turbine 28 and expand against vanes (not shown) thereof, turbine 28 may rotate and drive the connected compressor 24 to pressurize inlet air.

Particulate collection device 35 may comprise a particulate filter located downstream of turbine 28 to remove soot from the exhaust flow of power system 10. It is contemplated that particulate collection device 35 may include an electrically conductive or non-conductive coarse mesh metal or porous ceramic honeycomb medium or other like substrate. As the exhaust flows through the medium, particulates may be blocked by and left behind in the medium. Over time, the particulates may build up within the medium and, if unaccounted for, could negatively affect engine performance.

To minimize negative effects on engine performance, the collected particulates may be passively and/or actively removed through a process called regeneration. When passively regenerated, the particulates deposited on the filtering medium may chemically react with a catalyst, for example, a base metal oxide, a molten salt, and/or a precious metal that is coated on or otherwise included within particulate collection device 35 to lower the ignition temperature of the particulates. Because particulate collection device 35 may be closely located downstream of engine block 12 (e.g., immediately downstream of turbine 28, in one example), the temperatures of the exhaust flow entering particulate collection device 35 may be high enough, in combination with the catalyst, to burn away the trapped particulates. When actively regenerated, heat may be applied to the particulates deposited on the filtering medium to elevate the temperature thereof to an ignition threshold. For this purpose, an active regeneration device 36 may be located proximal (e.g., upstream of) particulate collection device 35. The active regeneration device may include, for example, a fuel-fired burner, an electric heater, or any other device known in the art. A combination of passive and active regeneration may be utilized, if desired. Alternatively, as will be described below with respect to FIG. 2, particulate collection device 35 and regeneration device 36 may be omitted.

Treatment device 32 may receive exhaust from turbine 28 and may be configured to catalytically reduce constituents of the exhaust to innocuous gases. In one example, treatment device 32 may embody an SCR device having reduction catalyst materials disposed on a metallic or ceramic substrate 38. For example, such reduction catalyst materials may include platinum or palladium, and the substrate 38 may comprise an inorganic oxide such as titania, zirconia, alumina, or combinations thereof. Alternatively, substrate 38 may comprise one or more ceramic materials such as cordierite. In still further embodiments, substrate 38 may be made from one or more of the reduction and/or oxidation catalyst materials described herein via an extrusion process and/or any other known process. In such embodiments, substrate 38 may, itself, comprise one or more extruded reduction and/or oxidation catalyst materials. A gaseous or liquid reductant, such as urea, a water-urea mixture, or ammonia may be sprayed or otherwise advanced into the exhaust upstream of catalyst substrate 38 by a reductant injector (not shown). As the reductant is absorbed onto the surface of substrate 38, the reductant may react with NOx (NO and $NO_2$) in the exhaust, in the presence of the reduction catalyst materials discussed above, to form water ($H_2O$) and elemental nitrogen ($N_2$).

In additional embodiments, such as the embodiment shown in FIG. 1, hydrocarbons present in the exhaust may be utilized in place of the urea, water-urea mixture, ammonia, or other reductants described above to catalytically react with NOx at the substrate 38. Such hydrocarbons may be present in the exhaust as byproducts of the combustion process. Alternatively, and/or in addition, such hydrocarbons may be added to the exhaust upstream of treatment device 32. In still further embodiments, such hydrocarbons may be added to cylinders 14 for combustion, and the addition of such hydrocarbons may assist in the catalytic reduction of NOx at the substrate 38. For example, exhaust system 18 may include a hydrocarbon source 52 containing a supply of solid, liquid and/or gaseous hydrocarbons. Such hydrocarbons may include, for example, methane, ethane, propane, gasoline, ethanol, diesel fuel, and/or other known hydrocarbons. As will be described in greater detail below, hydrocarbon source 52 may be configured to selectively increase hydrocarbon levels in exhaust passing through treatment device 32 in order to increase the NOx conversion efficiency of treatment device 32. As used herein, the term "conversion efficiency" may be defined as the percentage of NOx passing through treatment device 32 that is catalytically reduced by substrate 38. As the conversion efficiency of treatment device 32 increases, a greater percentage of NOx is reduced by substrate 38. Alternatively and/or in addition, hydrocarbon source 52 may assist in varying the relative percentages (i.e., the ratio) of various hydrocarbons present in the exhaust in order to improve the efficiency of such catalytic reactions. It is also understood that in exemplary embodiments in which one of first and second fuel sources 30, 31 includes diesel fuel or another acceptable hydrocarbon reductant, hydrocarbon source 52 may be omitted and the one of first and second fuel sources 30, 31 may be configured to perform the functions of hydrocarbon source 52.

In exemplary embodiments, hydrocarbon source 52 may comprise a tank, reservoir, and/or other like structure configured to store hydrocarbons in solid, liquid, or gaseous form. In exemplary embodiments, hydrocarbon source 52 may store hydrocarbons having more carbon atoms than methane. Such hydrocarbons will be referred to for the duration of this disclosure as "heavy hydrocarbons," and such heavy hydrocarbons may include, for example, propane, ethane, gasoline, ethanol, diesel fuel, and the like. In an exemplary embodiment, hydrocarbon source 52 may be fluidly connected to and/or otherwise associated with the engine of power system 10 via a passage 56. In such embodiments, hydrocarbon source 52 may be configured to direct hydrocarbons into cylinders 14 for combustion such that total hydrocarbon levels in the combustion exhaust may be correspondingly increased. Moreover, hydrocarbon source 52 may be configured to selectively direct stored hydrocarbon into cylinders 14 in order to correspondingly increase a ratio of the stored hydrocarbon to one or more other hydrocarbons in the exhaust.

In alternative embodiments, hydrocarbon source 52 may be fluidly connected to exhaust passageway 26 via a passage 58 (shown in dashed lines in FIG. 1). In such embodiments, hydrocarbons stored in hydrocarbon source 52 may be injected into and/or otherwise introduced into combustion exhaust downstream of cylinders 14 and upstream of treatment device 32. Although FIG. 1 illustrates passage 58 being fluidly connected to exhaust passageway 26 immediately upstream of treatment device 32, in additional exemplary embodiments, passage 58 may be fluidly connected to exhaust passageway 26 anywhere downstream of the engine, such as between cylinders 14 and turbine 28. In such embodiments, hydrocarbon source 52 may be configured to selectively direct stored hydrocarbons into exhaust passage 26 in order to correspondingly increase a ratio of the stored hydrocarbons to one or more other hydrocarbons in the exhaust upstream of treatment device 32.

In exemplary embodiments, hydrocarbons may be stored within hydrocarbon source 52 at any desired positive pressure. In such embodiments, hydrocarbon source 52 and/or passages 56, 58 may include one or more valves, injectors, flow restrictors, and/or other like flow control devices (not shown) configured to assist in providing a pressurized flow of hydrocarbons from hydrocarbon source 52 to the engine (via passage 56) or to exhaust passageway 26 (via passage 58).

Alternatively, hydrocarbon source 52 may be fluidly connected to a pump 54 configured to pressurize the hydrocarbons stored within hydrocarbon source 52 and direct a pressurized flow of hydrocarbons to the engine (via passage 56) or to exhaust passageway 26 (via passage 58). As described above, passages 56, 58 may include one or more valves, injectors, flow restrictors, and/or other like flow control devices (not shown), and together with pump 52, operation of such flow control devices may be controlled to regulate the flow and/or amount of hydrocarbons provided from hydrocarbon source 52.

The reduction process performed by substrate 38 may be most effective when a concentration of NO to $NO_2$ supplied to substrate 38 is about 1:1. To help provide a desired concentration of NO to $NO_2$, an oxidation catalyst 44 may be located upstream of substrate 38, in some embodiments. Oxidation catalyst 44 may be, for example, a diesel oxidation catalyst (DOC) or any other known oxidation catalyst. Oxidation catalyst 44 may include a porous ceramic honeycomb structure or a metal mesh substrate coated with a catalyst material, for example a precious metal, that catalyzes a chemical reaction to alter the composition of the exhaust. For example, oxidation catalyst 44 may include platinum that facilitates the conversion of NO to $NO_2$, and/or vanadium that suppresses the conversion. In further exemplary embodiments, oxidation catalyst may comprise a combination of metallic oxidation catalyst materials and inorganic oxides configured to accelerate the reaction of NO with oxygen to produce $NO_2$. In exemplary embodiments, such metallic oxidation catalyst materials may include cobalt, silver, or combinations thereof, and such inorganic oxides may include titania, zirconia, alumina, or combinations thereof. In such exemplary embodiments, oxidation catalyst 44 may comprise cobalt catalyst materials disposed on a zirconia substrate.

Figure 2:
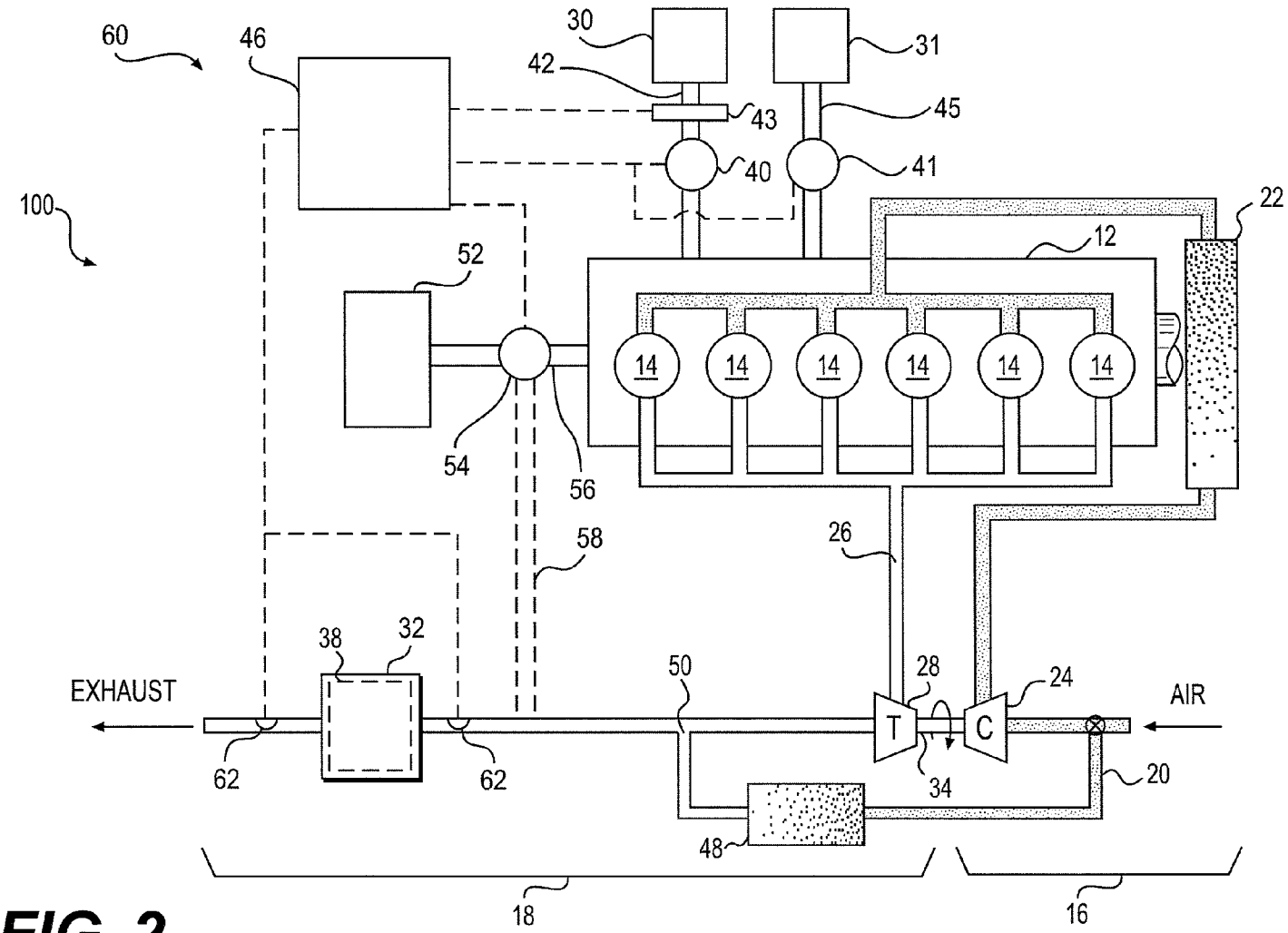
FIG. 2 is a schematic and diagrammatic illustration of another exemplary disclosed power system.

Although the embodiment of FIG. 1 illustrates oxidation catalyst 44 and treatment device 32 as being separate structures, in further exemplary embodiments, such as in the exemplary embodiment shown in FIG. 2, the reduction catalyst materials of treatment device 32 and the oxidation catalyst materials of oxidation catalyst 44 may be disposed on a single substrate. For example, a first portion of a single substrate may be coated with, dipped in, and/or otherwise provided with the oxidation catalyst materials described above and a second portion of the single substrate may be coated with, dipped in, and/or otherwise provided with the reduction catalyst materials. In such an exemplary embodiment, it may be desirable for the oxidation catalyst materials to be disposed upstream of the reduction catalyst materials. Alternatively, the reduction and oxidation catalyst materials may be substantially homogenously disposed throughout the substrate. In such embodiments, the reduction and oxidation catalyst materials may be mixed together, and the single substrate may be coated with, dipped in, and/or otherwise provided with the mixture of catalyst materials. For example, such a single substrate may comprise a zirconia mesh and/or other like support structure that has been coated with, dipped in, and/or otherwise provided with both cobalt oxidation catalyst materials and palladium reduction catalyst materials. In further exemplary embodiments, other mixtures of known oxidation and reduction catalyst materials may be employed on a known inorganic oxide substrate. In still further exemplary embodiments, as described above, substrate 38 itself may be made from the reduction and oxidation catalyst materials described herein via an extrusion process and/or any other known process.

Recirculation loop 20 may redirect gases from exhaust system 18 back into air induction system 16 for subsequent combustion. The recirculated exhaust gases may reduce the concentration of oxygen within the combustion chambers, and simultaneously lower the maximum combustion temperature therein. The reduced oxygen levels may provide fewer opportunities for chemical reaction with the nitrogen present, and the lower temperature may slow the chemical process that results in the formation of $NO_X$. A cooler 48 may be located within recirculation loop 20 to cool the exhaust gases before they are combusted. In the embodiment of FIG. 1, recirculation loop 20 may include an inlet 50 located to receive exhaust from a point upstream of both oxidation catalyst 44 and treatment device 32. In additional exemplary embodiments in which the oxidation and reduction catalyst materials are disposed on a single substrate, inlet 50 may be disposed upstream of the single substrate.

A control system 60 may be associated with power system 10, and control system 60 may include components configured to regulate the fuel and/or hydrocarbons provided to the engine in order to increase the conversion efficiency of treatment device 32. In additional exemplary embodiments, control system 60 may be configured to regulate the amount of hydrocarbons added to exhaust downstream of cylinders 14 in order to increase the conversion efficiency of treatment device 32. Specifically, control system 60 may include one or more sensors 62 configured to determine a characteristic of the exhaust, and a controller 58 in communication with sensors 62, pumps 40, 41, 54, mixer 43, and/or other components of power system 10 including but not limited to any of the additional flow control devices (not shown) described herein. Controller 46 may be configured to control operation of pumps 40, 41, 54, mixer 43, and/or other components of power system 10 in response to input received from sensors 62.

Sensors 62 may embody constituent sensors configured to generate a signal indicative of the presence of a particular constituent within the exhaust. For instance, sensors 62 may be NOx sensors configured to determine an amount (i.e., quantity, relative percentage, ratio, etc.) of NO and/or $NO_2$. If embodied as physical sensors, sensors 62 may be located upstream and/or downstream of treatment device 32. When located upstream of treatment device 32, a sensor 62 may be situated to sense a production of NOx by power system 10. When located downstream of treatment device 32, a sensor 62 may be situated to sense the production of NOx and/or a conversion efficiency of treatment device 32. Sensors 62 may generate a signal indicative of these measurements and send them to controller 46. In addition to, for example, a NOx level of the exhaust, sensors 62 may also be conjured to generate a signal indicative of, among other things, the total hydrocarbon level of the exhaust and an exhaust temperature.

It is contemplated that sensors 62 may alternatively embody virtual sensors. A virtual sensor may be a model-driven estimate based on one or more known or sensed operational parameters of power system 10 and/or treatment device 32. For example, based on a known operating speed, load, temperature, boost pressure, and/or other parameter of power system 10, a model may be referenced to determine an amount of NO and/or $NO_2$ produced by power system 10. Similarly, based on a known or estimated NOx production of power system 10, a flow rate of exhaust exiting power system 10, and/or a temperature of the exhaust, the model may be referenced to determine an amount of NO and/or $NO_2$ leaving treatment device 32. As a result, the signal directed from sensor 62 to controller 46 may be based on calculated and/or estimated values rather than direct measurements, if desired.

Controller 46 may embody a single microprocessor or multiple microprocessors that include a means for controlling an operation of pumps 40, 41, 54, mixer 43, and/or other components of power system 10 in response to signals received from sensors 62. Numerous commercially available microprocessors can be configured to perform the functions of controller 46. It should be appreciated that controller 46 could readily embody a general power system microprocessor capable of controlling numerous power system functions and modes of operation. Various other known circuits may be associated with controller 46, including power supply circuitry, signal-conditioning circuitry, solenoid driver circuitry, communication circuitry, and other appropriate circuitry.

Controller 46 may operate pumps 40, 41 such that corresponding desired amounts of first and second fuels are provided to the engine of power system 10 for combustion. In further exemplary embodiments, controller 46 may operate pump 54 such that a desired amount of hydrocarbon is provided to either the engine or exhaust passageway 26. Specifically, in order to enhance the conversion efficiency of treatment device 32, controller 46 may operate one or more of pumps 40, 41, 54 to achieve a desired level of hydrocarbons in the exhaust passing to treatment device 32. Additionally, controller 46 may operate one or more of pumps 40, 41, 54 to maintain, modify, and/or otherwise control a ratio of a desired hydrocarbon in the exhaust relative to various other hydrocarbons present in the exhaust in order to increase the conversion efficiency of treatment device 32. For example, based on signals received from one or more sensors 62, controller 46 may selectively increase or decrease a flow of hydrocarbons provided by pump 54 from hydrocarbon source 52. Additionally, based on signals received from one or more sensors 62, controller 46 may selectively increase or decrease a flow of a first fuel provided by pump 40 from first fuel source 30. A flow of a second fuel provided by pump 41 may be selectively increased or decreased in the same way. Controller 46 may operate pumps 40, 41, 54, mixer 43, and/or other components of power system 10 in an open-loop or closed-loop manner. In order to facilitate such control, controller 46 may include one or more algorithms, look-up tables, control maps, and/or other like means stored in a memory thereof. Signals received from sensors 62 may contain information used as inputs to such means, and controller 46 may generate one or more flow control commands corresponding to an output of such algorithms, look-up tables, and/or control maps.

FIG. 2 illustrates another exemplary power system 100 of the present disclosure. Wherever possible, like item numbers have been used to illustrate like components of FIGS. 1 and 2. For example, the exemplary power system 100 of FIG. 2 may be substantially identical to power system 10 of FIG. 1 except for the omission of particulate collection device 35, regeneration device 36, and oxidation catalyst 44. As it is understood in the art, the use of a dual fuel engine may eliminate the need for at least particulate collection device 35 and regeneration device 36. Additionally, in the exemplary embodiment of FIG. 2, reduction catalyst materials described above with respect to oxidation catalyst 44 may be disposed on, for example, substrate 38. Accordingly, in the exemplary embodiment of FIG. 2, oxidation catalyst materials and reduction catalyst materials may be disposed on single substrate 38 as described above. Alternatively, in the embodiment of FIG. 2, substrate 38 may be made from the reduction and oxidation catalyst materials described herein via an extrusion process and/or any other known process.

In still further exemplary embodiments of power systems 10, 100, an oxidation catalyst 44 may be disposed downstream of treatment device 32. Such a downstream oxidation catalyst may be in place of and/or in addition to an oxidation catalyst 44 disposed upstream of treatment device 32. Such a downstream oxidation catalyst 44 would allow excess hydrocarbons to be introduced into the cylinders 14 and/or treatment device 32, and would be configured to oxidize and or/otherwise react (i.e., "clean up") excess hydrocarbons slipping past treatment device 32.

INDUSTRIAL APPLICABILITY

The exhaust system 18 of the present disclosure may be used with any power system where it is desirable to minimize NOx levels in combustion exhaust. Such power systems may be employed with any type of machine useful in performing one or more tasks. Such machines may include, for example, wheel loaders, excavators, graders, on-highway vehicles, off-highway vehicles, and/or other like machines, and such tasks may include those typical in mining, construction, excavation, farming, and/or other industries. Power system 10 may provide power to one or more components of the machine to assist in performing such tasks and/or providing functionality to the machine. Such components may include, for example, one or more pumps, motors, fans, transmissions, wheels, tracks, gearboxes, or other like devices. Such components may further include one or more shovels, buckets, graders, or other like implements used by the machine to perform the tasks described above. Operation of power system 10 will now be described. For the duration of the present disclosure, treatment device 32 will be described as comprising a single substrate 38 including both oxidation and reduction catalyst materials disposed thereon. It is understood that in such embodiments, as described above with respect to FIG. 2, oxidation catalyst 44 may be omitted.

Referring to FIG. 1, air induction system 16 may pressurize and force air or a mixture of air and fuel into cylinders 14 of power system 10 for subsequent combustion. The fuel and air mixture may be combusted by power system 10 to produce a mechanical work output and an exhaust flow of hot gases. The exhaust flow may contain a complex mixture of air pollutants, which can include NOx and particulate matter. As this exhaust flow is directed from cylinders 14 through particulate collection device 35 and treatment device 32, soot may be collected and burned away, and $NO_X$ may be reduced to $H_2O$ and $N_2$. Simultaneously, exhaust may be drawn through cooler 48 and redirected back into air induction system 16 for subsequent combustion, resulting in a lower production of $NO_X$ by power system 10.

In exemplary embodiments in which power system 10 comprises a dual fuel engine, the composition of combustion exhaust may be modified in order to maximize the catalytic reduction of NOx at treatment device 32. In particular, by changing the ratio of fuels provided to a dual fuel engine for combustion, the resulting hydrocarbon composition of the exhaust (i.e., the relative proportions of the various hydrocarbons present in the exhaust) can be controlled to maximize the conversion efficiency of treatment device 32. For example, increasing the ratio of diesel fuel to natural gas provided to the engine for combustion may increase the ratio of heavy hydrocarbons to methane in the resulting exhaust gas, and such an increase in the proportion of heavy hydrocarbons will increase the conversion efficiency of treatment device 32. Since the hydrocarbon composition of combustion exhaust produced by single fuel engines is a direct result of the single fuel combusted by such engines, modifications to the hydrocarbon composition of the exhaust produced by such engines is not possible.

In exemplary embodiments, the hydrocarbon composition of exhaust directed to treatment device 32 may be modified in several different ways. For example, as described above, hydrocarbons may be directed from hydrocarbon source 52 to cylinders 14 (via passage 56) for combustion in order to increase a ratio of such hydrocarbons in the resulting exhaust relative to other hydrocarbons and/or exhaust components. In such exemplary embodiments, directing a flow of heavy hydrocarbons from hydrocarbon source 52 to cylinders 14 may increase the ratio of the heavy hydrocarbons to, for example, methane or other hydrocarbons naturally existing in the combustion exhaust. In exemplary embodiments, increasing the amount of heavy hydrocarbons passing through treatment device 32 may increase the NOx conversion efficiency of treatment device 32. Such an increase may also advantageously reduce the sensitivity of catalyst materials employed by treatment device 32 to water vapor carried by the exhaust.

In some exemplary embodiments, directing a flow of heavy hydrocarbons from hydrocarbon source 52 to cylinders 14 for combustion may increase the conversion efficiency of treatment device 32 to between approximately 50 percent and approximately 80 percent, at an exhaust temperature between approximately 400 degrees Celsius and approximately 500 degrees Celsius, while total hydrocarbon levels in the exhaust exiting the engine are maintained between approximately 2000 parts per million and approximately 2100 parts per million. In such embodiments, these relatively high conversion efficiencies may be realized by directing a relatively small amount of heavy hydrocarbons to cylinders 14. For example, in such embodiments the conversion efficiency of treatment device 32 may be increased to between approximately 50 percent and approximately 80 percent, at an exhaust temperature of approximately 450 degrees Celsius, by dosing between approximately 75 parts per million and approximately 300 parts per million of heavy hydrocarbons into cylinders 14 for combustion therein. In such embodiments, such an increase in conversion efficiency can be achieved without modifying a proportion of the first and second fuels provided to the engine from first and second fuel sources 30, 31. Accordingly, increasing the ratio of heavy hydrocarbons in the exhaust passing to treatment device 32 using this approach may be a relatively efficient use of onboard resources and may not require any additional fuel consumption.

In another exemplary embodiment, the composition of combustion exhaust may be modified by directing heavy hydrocarbons from hydrocarbon source 52 to the exhaust passageway 26 (via passage 58) upstream of treatment device 32. Similar to the method of directing a flow of heavy hydrocarbons from hydrocarbon source 52 to cylinders 14 described above, directing a flow of heavy hydrocarbons from hydrocarbon source 52 to exhaust passageway 26 upstream of treatment device 32 may increase the conversion efficiency of treatment device 32 to between approximately 50 percent and approximately 80 percent, at an exhaust temperature between approximately 400 degrees Celsius and approximately 500 degrees Celsius, while total hydrocarbon levels in the exhaust exiting the engine are maintained between approximately 2000 parts per million and approximately 2100 parts per million. In such embodiments, these relatively high conversion efficiencies may be realized by directing a relatively small amount of heavy hydrocarbons to exhaust passageway 26. For example, in such embodiments the conversion efficiency of treatment device 32 may be increased to between approximately 50 percent and approximately 80 percent, at an exhaust temperature of approximately 450 degrees Celsius, by directing between approximately 75 parts per million and approximately 300 parts per million of heavy hydrocarbons into exhaust passageway 26.

In a further exemplary embodiment, the composition of combustion exhaust may be modified by changing a ratio of a first fuel provided to the engine to a second fuel provided to the engine. For example, by increasing the proportion of diesel fuel or another petroleum-based fuel provided to the dual fuel engine relative to, for example, natural gas, the total hydrocarbon level of the exhaust may be increased. In such embodiments, hydrocarbon source 52 and pump 54 may be omitted. By increasing the total hydrocarbon level of the exhaust, the conversion efficiency of treatment device 32 may be increased. For example, by increasing the total amount of hydrocarbons in the exhaust to between approximately 2400 parts per million and approximately 2600 parts per million, the conversion efficiency of treatment device 32 may be increased to between approximately 50 percent and approximately 80 percent, at an exhaust temperature of approximately 450 degrees Celsius. Additionally, increasing the total hydrocarbon level of the exhaust has the beneficial effect of reducing the sensitivity of treatment device 32 to water vapor inevitably present in combustion exhaust. While increasing the ratio of diesel fuel or other petroleum-based fuel provided to the dual fuel engine relative to, for example, natural gas may be possible with dual fuel engines, single fuel engines are not capable of such functionality. Accordingly, single fuel engines are not configured to increase the conversion efficiency of treatment device 32, or to decrease the sensitivity to water vapor, utilizing the various method described herein.

Moreover, it is understood that controller 46 may be employed to increase, decrease, maintain, and/or otherwise control the levels, ratios, proportions, and/or flows of fuel and/or hydrocarbons described herein in response to one or more signals received from sensors 62. For example, sensors 62 may generate and direct one or more signals indicative of, for example, a NOx level of the exhaust, a hydrocarbon level of the exhaust, and/or an exhaust temperature to controller 46. Controller 46 may use information contained in such signals as inputs to one or more of the algorithms, look-up tables, control maps, and/or other like means stored in a controller memory. Such means may produce an output indicative of a desired level, ratio, proportion, and/or flow of fuel and/or hydrocarbons. Such desired values may be generated in order to increase and/or maximize the NOx conversion efficiency of treatment device 32. Controller 46 may generate control signals corresponding to such outputs and may direct the control signals to pumps 40, 41, 54, mixer 43, and/or other components of power system 10, in an open-loop or closed-loop manner, to achieve the desired level, ratio, proportion, and/or flow of fuel and/or hydrocarbons.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A power system, comprising:

a dual fuel engine;

a first fuel source configured to provide a first fuel to the engine;

a second fuel source configured to provide a second fuel to the engine different than the first fuel; and an exhaust system configured to receive combustion exhaust from the engine, the exhaust system including a reduction catalyst comprising palladium catalyst material and an oxidation catalyst comprising cobalt catalyst material, the reduction catalyst being configured to reduce NOx, wherein a first ratio of the first fuel relative to the second fuel is selected to increase a second ratio of heavier hydrocarbons to methane in the combustion exhaust.

2. The power system of claim 1, further including a single zirconia substrate, the palladium catalyst material and the cobalt catalyst material both being disposed on the single substrate.

3. The power system of claim 1, further including a first zirconia substrate and a second zirconia substrate separate from and downstream of the first substrate, the cobalt catalyst material being disposed on the first substrate and the palladium catalyst material being disposed on the second substrate.

4. The power system of claim 1, wherein the engine is configured to combust diesel fuel, and a mixture of natural gas and air, and wherein the first fuel comprises diesel fuel and the second fuel comprises natural gas.

5. The power system of claim 1, wherein the exhaust comprises a total hydrocarbon level between approximately 2000 parts per million and approximately 2100 parts per million, and the NOx conversion efficiency of the reduction catalyst is maintained between approximately 50 percent and approximately 80 percent.

6. The power system of claim 1, wherein the oxidation catalyst is disposed upstream of the reduction catalyst, the oxidation catalyst being configured to convert NO in the combustion exhaust to $NO_2$ and the reduction catalyst being configured to reduce NOx in the combustion exhaust received from the oxidation catalyst to elemental nitrogen.

7. The power system of claim 1, further comprising a hydrocarbon source containing a supply of hydrocarbons, and a pump fluidly connected to the hydrocarbon source and configured to direct a pressurized flow of the hydrocarbons to at least one of the engine and the exhaust system.

8. The power system of claim 7, wherein the hydrocarbons comprise one of propane, ethane, gasoline, ethanol, and diesel fuel.

9. The power system of claim 7, wherein the pressurized flow of the hydrocarbons comprises between approximately 75 parts per million and approximately 300 parts per million of heavy hydrocarbons, and wherein directing the pressurized flow to the at least one of the engine and the exhaust system increases the NOx conversion efficiency of the reduction catalyst to between approximately 50 percent and approximately 80 percent.

10. A machine, comprising:

a dual fuel engine configured to provide power to a component of the machine and to produce a combustion exhaust;

an exhaust system configured to receive the exhaust, the exhaust system including a treatment device having a reduction catalyst, an oxidation catalyst, and a substrate, the reduction catalyst comprising palladium catalyst material, the oxidation catalyst comprising cobalt catalyst material, and the substrate comprising an inorganic oxide, the reduction catalyst being configured to reduce NOx;

a sensor configured to determine a characteristic of the exhaust and to generate a signal indicative of the characteristic; and a controller in communication with the engine, the exhaust system, and the sensor, the controller configured to change a first ratio of a first fuel provided to the engine relative to a second fuel provided to the engine to increase a second ratio of heavier hydrocarbons to methane in the exhaust.

11. The machine of claim 10, further comprising a hydrocarbon source containing a supply of hydrocarbons, and a pump fluidly connected to the hydrocarbon source and configured to direct a pressurized flow of the hydrocarbons to at least one of the engine and the exhaust system.

12. The machine of claim 11, wherein the exhaust system includes an exhaust passageway fluidly connecting the engine to the treatment device, the pump configured to direct the pressurized flow of hydrocarbons to the exhaust passageway upstream of the treatment device.

13. The machine of claim 11, wherein the characteristic comprises at least one of a NOx level of the exhaust, a hydrocarbon level of the exhaust, and an exhaust temperature.

14. The machine of claim 11, wherein changing the first ratio increases a NOx conversion efficiency of the reduction catalyst to between approximately 50 percent and approximately 80 percent.

15. The machine of claim 11, wherein the controller is configured to control the pump to direct the pressurized flow of hydrocarbons to the at least one of the engine and the exhaust system in response to the signal.

16. The machine of claim 15, wherein the pressurized flow of the hydrocarbons comprises between approximately 75 parts per million and approximately 300 parts per million of heavy hydrocarbons, and directing the pressurized flow to the at least one of the engine and the exhaust system increases a NOx conversion efficiency of the reduction catalyst to between approximately 50 percent and approximately 80 percent.

17. A method of controlling a power system, comprising:

providing a first fuel to a dual fuel engine;

providing a second fuel to the engine different than the first fuel;

combusting the first and second fuels with the engine to produce combustion exhaust containing NOx and having a desired total hydrocarbon level;

oxidizing a portion of the exhaust with an oxidation catalyst comprising cobalt catalyst material; and reducing the NOx with a reduction catalyst comprising palladium catalyst material, wherein providing the first fuel and the second fuel includes selectively changing a first ratio of the first fuel provided to the engine relative to the second fuel provided to the engine to increase a second ratio of heavier hydrocarbons to methane in the combustion exhaust.

18. The method of claim 17, further including changing the first ratio such that a desired total hydrocarbon level of the combustion exhaust is between approximately 2000 parts per million and approximately 2100 parts per million, and directing a flow of pressurized heavy hydrocarbons to at least one of the engine and an exhaust passageway fluidly connecting the engine to the reduction catalyst, the flow of pressurized heavy hydrocarbons increasing a NOx conversion efficiency of the reduction catalyst to between approximately 50 percent and approximately 80 percent.

19. The method of claim 17, further including increasing a NOx conversion efficiency of the reduction catalyst to between approximately 50 percent and approximately 80 percent by selectively changing the first ratio.

20. The method of claim 19, wherein the first fuel comprises diesel fuel, the second fuel comprises natural gas, and a desired total hydrocarbon level in the combustion exhaust is between approximately 2400 parts per million and approximately 2600 parts per million.

* * * * *